US011821195B1

(12) United States Patent
Farber

(10) Patent No.: US 11,821,195 B1
(45) Date of Patent: Nov. 21, 2023

(54) PORTABLE MULTIUSER SAUNA

(71) Applicant: West Coast Steam, Inc., Portland, OR (US)

(72) Inventor: Berley Scott Farber, Portland, OR (US)

(73) Assignee: WEST COAST STEAM, INC., Portland, OR (US)

( * ) Notice: Subject to any disclaimer, the term of this patent is extended or adjusted under 35 U.S.C. 154(b) by 0 days.

(21) Appl. No.: 18/226,692

(22) Filed: Jul. 26, 2023

Related U.S. Application Data

(60) Provisional application No. 63/369,481, filed on Jul. 26, 2022.

(51) Int. Cl.

| | |
|---|---|
| ***E04B 1/343*** | (2006.01) |
| ***E04B 1/61*** | (2006.01) |
| ***A61H 33/06*** | (2006.01) |
| ***E04B 1/00*** | (2006.01) |

(52) U.S. Cl.
CPC ..... *E04B 1/34317* (2023.08); *A61H 33/063* (2013.01); *A61H 33/065* (2013.01); *A61H 33/066* (2013.01); *E04B 1/34321* (2013.01); *E04B 1/6112* (2013.01); *A61H 2033/061* (2013.01); *A61H 2033/068* (2013.01); *A61H 2201/0107* (2013.01); *A61H 2201/0157* (2013.01); *E04B 2001/0092* (2013.01); *E04B 2001/6195* (2013.01)

(58) Field of Classification Search
CPC ..... E04B 1/34317; E04B 1/34321; E04B 1/6112; E04B 2001/0092; E04B 2001/6195; A61H 33/063; A61H 33/065; A61H 33/066; A61H 2033/061; A61H 2033/068; A61H 2201/0107; A61H 2201/0157
USPC ..... 4/524, 535
See application file for complete search history.

(56) References Cited

U.S. PATENT DOCUMENTS

| | | | | | |
|---|---|---|---|---|---|
| 2,143,039 | A | * | 1/1939 | Stoddard | A47L 15/0084 220/849 |
| 2,303,465 | A | * | 12/1942 | Howard | A61H 33/06 392/394 |
| 2,725,577 | A | * | 12/1955 | Howard | A61H 33/06 392/394 |
| 2,780,226 | A | * | 2/1957 | Taves | A61H 33/06 607/83 |
| 3,271,786 | A | * | 9/1966 | Joy | A61H 33/06 607/81 |
| 3,290,697 | A | * | 12/1966 | Anderson | A61H 33/06 4/532 |
| 3,396,411 | A | * | 8/1968 | Vieceli | A61H 33/06 4/525 |

(Continued)

FOREIGN PATENT DOCUMENTS

| | | | |
|---|---|---|---|
| EP | 24714 | A * | 3/1981 |
| EP | 1815836 | A1 * | 8/2007 |

(Continued)

*Primary Examiner* — Lori L Baker
(74) *Attorney, Agent, or Firm* — TIPS Group

(57) ABSTRACT

A portable multiuser sauna includes an enclosure configured as a truncated, regular icosahedron with ten sidewall triangular structural panels and five rooftop triangular structural panels, wherein each sidewall triangular structural panel is compressively coupled to at least two adjacent triangular structural panels.

27 Claims, 7 Drawing Sheets

(56) References Cited

U.S. PATENT DOCUMENTS

| | | | | | |
|---|---|---|---|---|---|
| 3,452,369 | A * | 7/1969 | Haldon | A61H 33/06 | 219/400 |
| 3,707,732 | A * | 1/1973 | Cosper | A61H 33/06 | 4/532 |
| 4,277,855 | A * | 7/1981 | Poss | A61H 33/06 | 4/531 |
| 4,862,526 | A * | 9/1989 | Berger | A61H 33/06 | 4/525 |
| 11,147,738 | B1 * | 10/2021 | Nunez | A61H 33/067 | |
| 2012/0005968 | A1 * | 1/2012 | Patino | E04H 1/02 | 52/745.13 |
| 2013/0098415 | A1 * | 4/2013 | Zeldin | E04H 15/12 | 135/96 |
| 2016/0271012 | A1 * | 9/2016 | Xu | A61H 33/6021 | |
| 2017/0326026 | A1 * | 11/2017 | Kasbohm | A47K 3/38 | |
| 2018/0092805 | A1 * | 4/2018 | Perovic | A61H 33/06 | |
| 2021/0177694 | A1 * | 6/2021 | Arnold | A61H 33/065 | |
| 2022/0062100 | A1 * | 3/2022 | Urfig | A61H 33/065 | |
| 2023/0167636 | A1 * | 6/2023 | Keller | E04B 1/14 | 52/91.3 |

FOREIGN PATENT DOCUMENTS

| | | | | |
|---|---|---|---|---|
| EP | 3208537 | A1 * | 8/2017 | |
| GB | 2136286 | A * | 9/1984 | |
| WO | WO-0124761 | A1 * | 4/2001 | |
| WO | WO-2007107621 | A1 * | 9/2007 | |
| WO | WO-2020140131 | A1 * | 7/2020 | |
| WO | WO-2021252918 | A1 * | 12/2021 | A61H 33/063 |
| WO | WO-2023047272 | A1 * | 3/2023 | |

* cited by examiner

PORTABLE MULTIUSER SAUNA

CROSS REFERENCE TO RELATED APPLICATION

This application claims the benefit of Provisional Patent Application No. 63/369,481, filed Jul. 26, 2022, incorporated herein by reference.

BACKGROUND

Saunas, such as dry saunas and wet saunas (a/k/a steam baths) have well-known physiological restive effects. Tension and other physical stress can be relieved through the dry-heated air of a dry sauna or the heavy moist air of a steam bath. Unfortunately, the desirable effects produced by saunas have been traditionally offset by the problems of effective design, efficient use of space, and economics.

Saunas and steam baths are popularly known to be integral "rooms" of homes, fitness centers, or health spas. They typically have flat roofs, which can lead to condensation dropping on users. Furthermore, portable saunas and steam baths have been developed (reference U.S. Pat. Nos. 3,271,786 and 3,707,732) but their portability is directly dependent upon their small size, e.g. typically only one person can make use of the sauna at any given time.

Saunas and steam rooms are both much more enjoyable and effective when more than one person can occupy them. Furthermore, the closed, cramped quarters of a typical portable sauna can, at least with some people, cause more tension than the therapeutic effect of the sauna or steam bath can remove. Portable saunas thus have had limited value, psychologically if not physiologically.

These and other limitations of the prior art will become apparent to those of skill in the art upon a reading of the following descriptions and a study of the several figures of the drawing.

SUMMARY

An example portable multiuser sauna includes an enclosure configured as a truncated, regular icosahedron with ten sidewall triangular structural panels and five rooftop triangular structural panels, wherein each sidewall triangular structural panel is compressively coupled to at least two adjacent triangular structural panels. In an embodiment, each of the triangular structural panels include a substantially planar outer surface configured as a first equilateral triangle having a first set of three congruent edges and defining a first centroid; a plurality of compression connectors coupled to the outer surface proximate to a plurality of edges of the first set of three congruent edges; a substantially planar inner surface configured as a second equilateral triangle having a second set of three congruent edges and defining a second centroid, wherein edges of the first set of three congruent edges are longer than the edges of the second set of three congruent edges, wherein each edge of the first set of three congruent edges is substantially parallel with a corresponding edge of the second set of three congruent edges, and wherein an axis through the first centroid and the second centroid is substantially perpendicular to the outer surface and the inner surface; three compression sidewalls extending between corresponding edges of the first set of three congruent edges and the second set of three congruent edges. A heater unit provides at least one of heated air and steam within the enclosure.

An example method for assembling a portable multiuser sauna includes coupling ten sidewall triangular structural panels together in a closed loop by compressively latching vertically extending edges of alternately oriented sidewall triangular structural panels; coupling five rooftop triangular structural panels together as a five sided pyramid on top of the ten sidewall triangular structural panels by compressively latching the rooftop triangular structural panels to each other and to five of the sidewall triangular structural panels, whereby the sidewall triangular structural panels and the roof building panels comprise an enclosure supported by the compressive coupling of the triangular structural panels without the need for a support structure; and installing a heater unit to provide at least one of heated air and steam within the enclosure.

An example compression mounted triangular structural panel includes a substantially planar outer surface configured as a first equilateral triangle having a first set of three congruent edges and defining a first centroid; a plurality of compression connectors coupled to the outer surface proximate to a plurality of edges of the first set of three congruent edges; a substantially planar inner surface configured as a second equilateral triangle having a second set of three congruent edges and defining a second centroid, wherein edges of the first set of three congruent edges are longer than the edges of the second set of three congruent edges, wherein each edge of the first set of three congruent edges is substantially parallel with a corresponding edge of the second set of three congruent edges, and wherein an axis through the first centroid and the second centroid is substantially perpendicular to the outer surface and the inner surface; and three compression sidewalls extending between corresponding edges of the first set of three congruent edges and the second set of three congruent edges.

An advantage of embodiments disclosed herein is that the sauna enclosure is supported by the compressive coupling of the triangular structural panels without the need for a support structure.

Another advantage of embodiments disclosed herein is that the portable multiuser sauna can be easily assembled and disassembled without tools.

Yet another advantage is that the disassembled triangular structural panels can be shipped flat.

A still further advantage is that the triangular structural panels are of similar design, which reduces costs and facilitates interchangeability.

Yet another advantage is that by properly sizing the triangular structural panels the internal chamber of the sauna's enclosure can accommodate multiple people at the same time.

These and other embodiments, features and advantages will become apparent to those of skill in the art upon a reading of the following descriptions and a study of the several figures of the drawing.

BRIEF DESCRIPTION OF THE DRAWINGS

Several example embodiments will now be described with reference to the drawings, wherein like components are provided with like reference numerals. The example embodiments are intended to illustrate, but not to limit, the invention. The drawings include the following figures.

DETAILED DESCRIPTION OF EXAMPLE EMBODIMENTS

Figure 1:
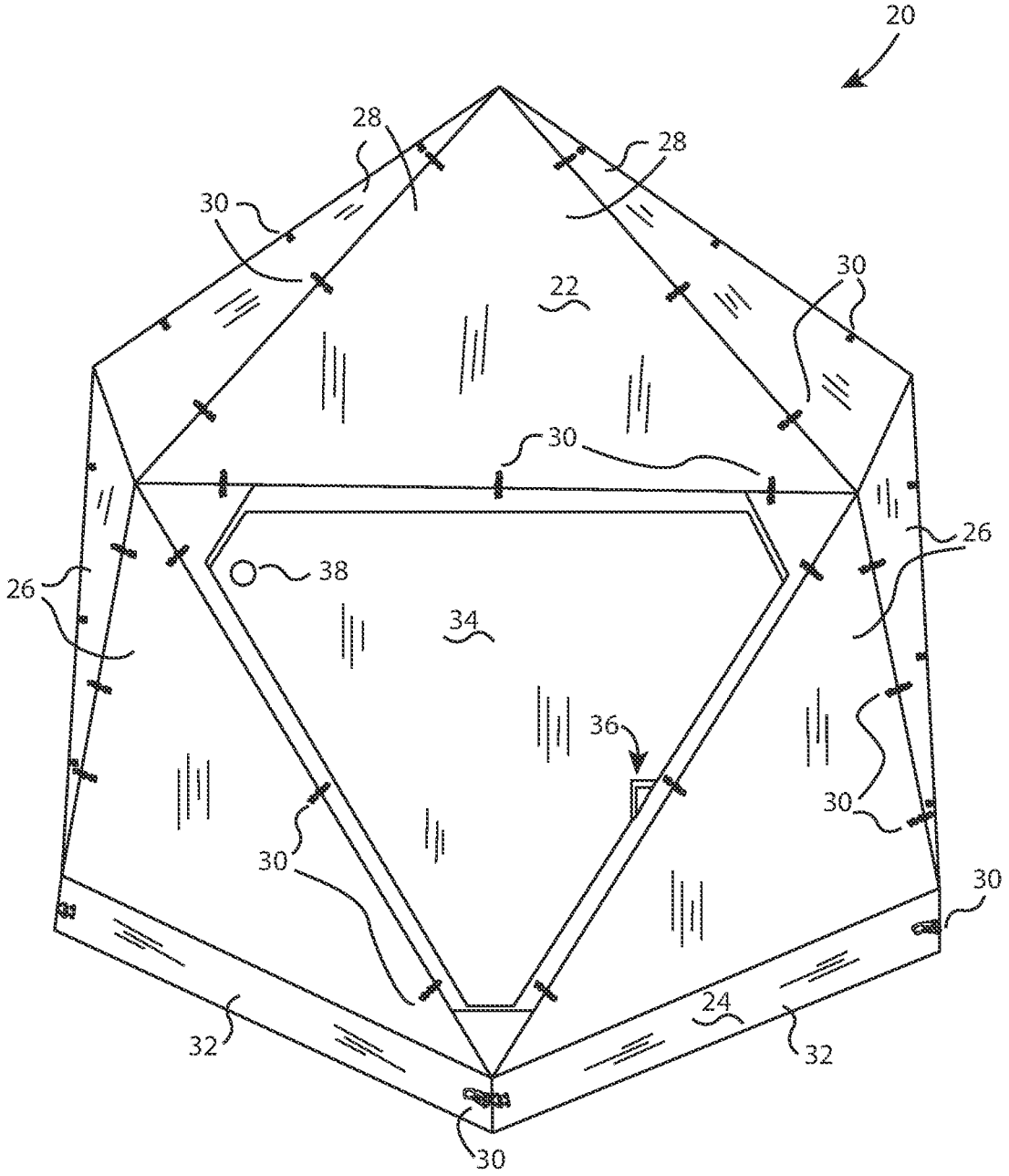
FIG. 1 is a perspective view of an example portable multiuser sauna.

In FIG. 1 is a perspective view of an example portable multiuser sauna 20 including an enclosure 22 sitting on a perimeter foundation 24. The enclosure 22 is configured as a truncated, regular icosahedron with ten sidewall triangular structural panels 26 and five rooftop triangular structural panels 28. In geometry, a regular icosahedron is a convex, regular polyhedron in Euclidean space with twenty congruent equilateral triangular faces and is one of the five Platonic solids. As used herein, a "truncated, regular icosahedron" refers to an enclosure having fifteen of the twenty faces of a regular, convex icosahedron, e.g. the ten sidewall triangular structural panels 26 coupled together in a closed loop and the five rooftop triangular structures 28 coupled together into a five-sided pyramid. The triangular structures are preferably coupled together by a plurality of compression connectors 30 provided along at least two of their edges. The perimeter foundation 24 includes five foundation segments 32 that are coupled together by a plurality of compression connectors 30 at adjacent ends. Also seen in this perspective view is a door 34 configured as an inverted, truncated triangle and having a hinge 36 and a knob 38.

Figure 2:
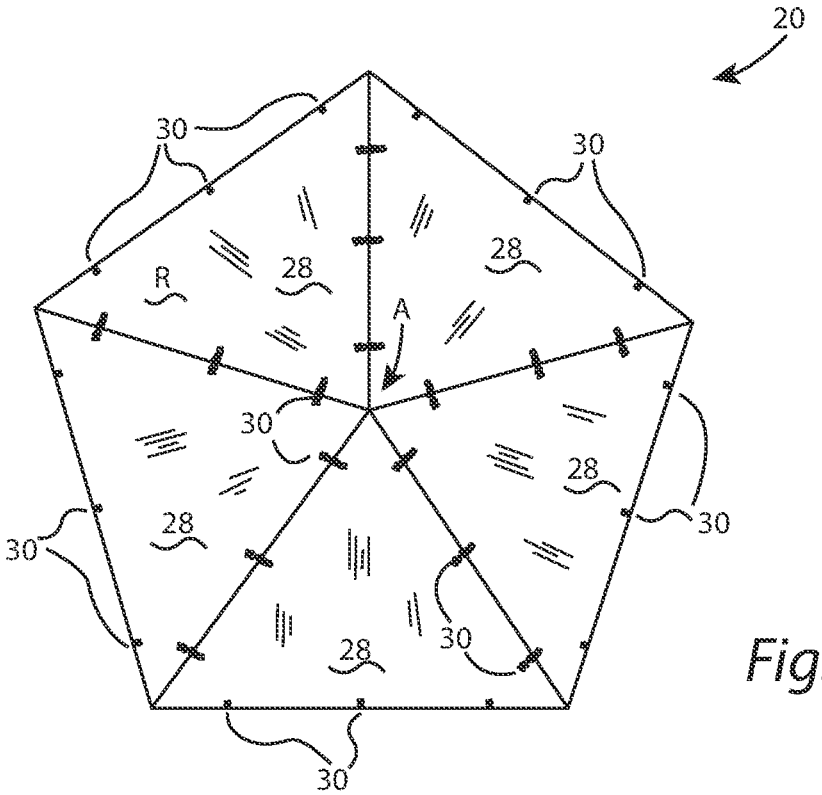
FIG. 2 is a top plan view of the sauna of FIG. 1.

FIG. 2 is a top plan view of the sauna 20 of FIG. 1 illustrating the five rooftop triangular structural panels 28 held together by a number of compression connectors 30. The five rooftop triangular structural panels 28 form a five-sided pyramidal roof R having an apex A at the point of contact of upper vertices of the five triangular structural panels 28. In this embodiment, three compression connectors are provided along each of the three edges of the five triangular structural panels 28 to compressively attach the structural panels together and to attach the five-sided pyramidal roof R to five of the sidewall triangular structural panels 26. In an alternate embodiment, the upper vertices of the five triangular structural panels 28 are truncated and a cap is provided at the top of the roof.

Figure 3:
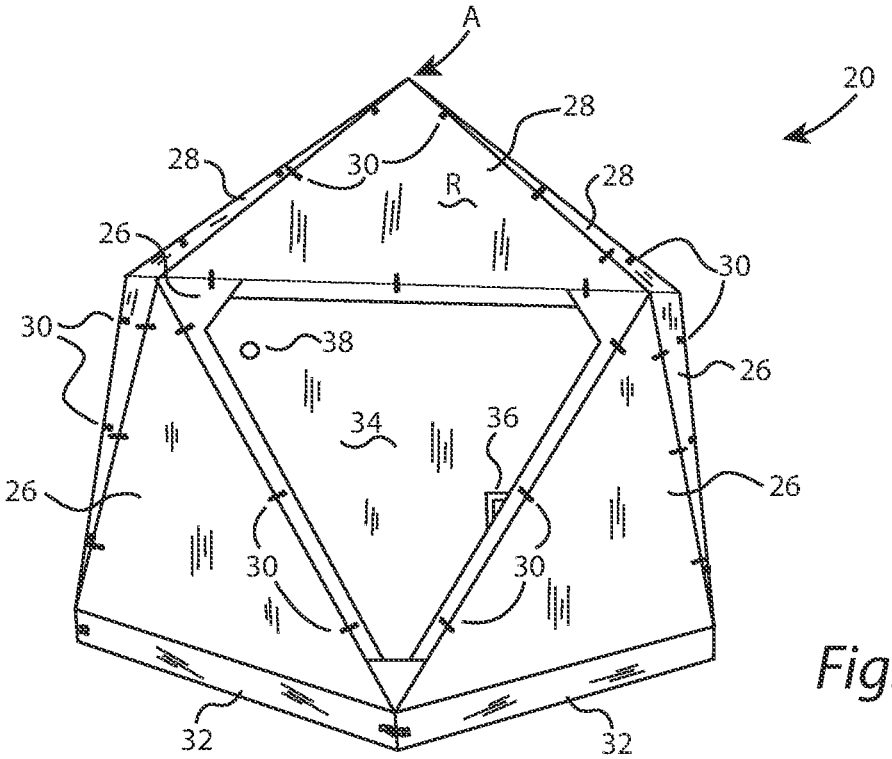
FIG. 3 is a front elevational view of the sauna of FIG. 1.

FIG. 3 is a front elevational view of sauna 20 further illustrating the assembly of the pyramidal roof R, sidewall structural panels 26, and foundation segments 32, which held together by compression connectors 30. The door 34 forming a part of a sidewall structural panel 26 is closed to substantially enclose an interior chamber C (see FIGS. 6 and 7) of the sauna 20. In an alternate embodiment the roof R is truncated and a cap is provided over the top of the roof.

Figure 4:
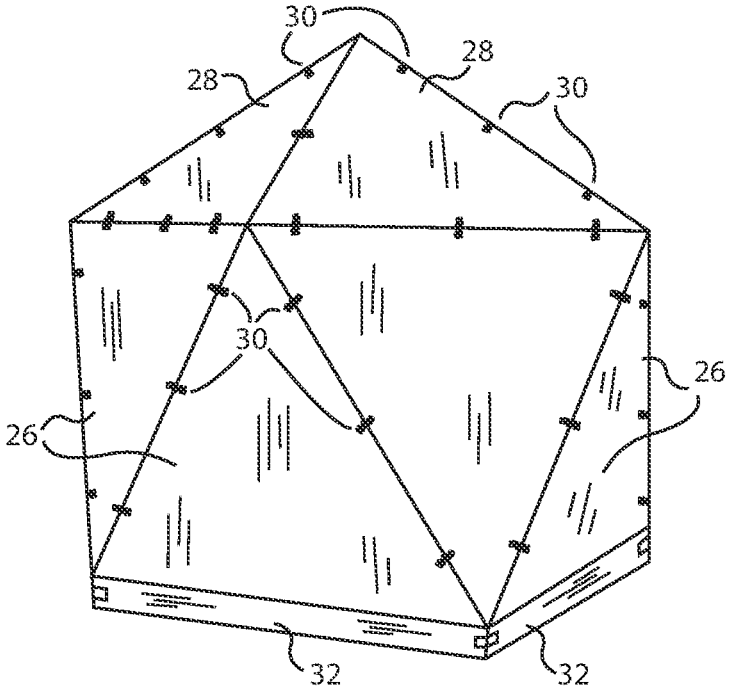
FIG. 4 is a left side elevational view of the sauna of FIG. 1, the right side elevational view being a mirror image thereof.

FIG. 4 is a left side elevational view of sauna 20, where the right side elevational view is a mirror image thereof. This figure further illustrates the assembly of the pyramidal roof R, sidewall structural panels 26, and foundation segments 32, which held together by compression connectors 30. The door 34 is not seen from this view.

Figure 5:
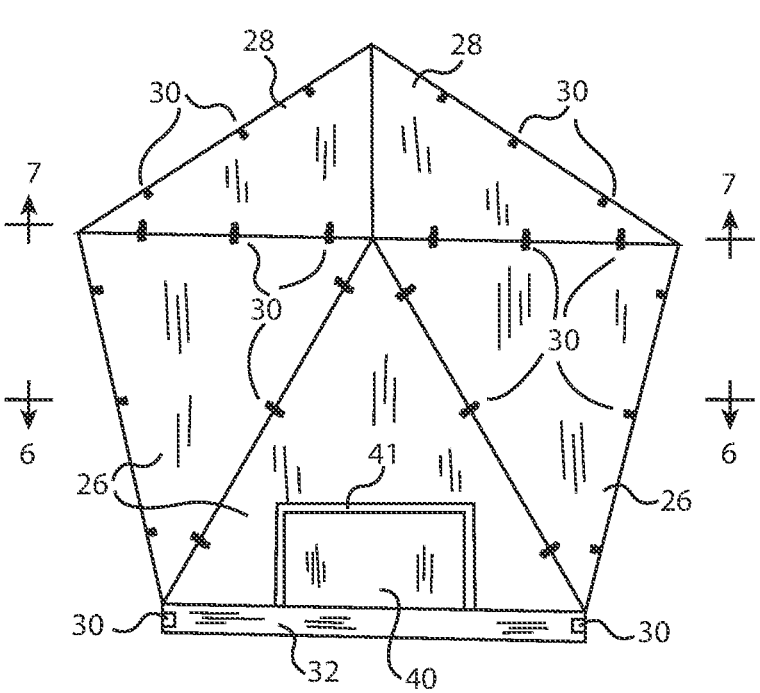
FIG. 5 is a rear elevational view of the sauna of FIG. 1.

FIG. 5 is a rear elevational view of the sauna 20 further illustrating the assembly of the pyramidal roof R, sidewall structural panels 26, and foundation segments 32, which are held together by compression connectors 30. Also seen is a heater unit 40 which is installed through an opening 41 provided in the panel and which provides at least one of heated air and steam (i.e. heated air and/or steam) within the chamber C (see FIGS. 6 and 7) of the sauna 20. For example, the heater unit can be a dry sauna heater which typically use electrical resistance, natural gas, or propane gas heater units to heat rocks positioned within the chamber C. The heater unit can also be a wet sauna heater (a/k/a steam generator) and use electrical, natural gas or propane power to produce steam within the chamber C. The heater unit can also be a combination of a dry sauna heater and a wet sauna heater. Other power sources, such as firewood, can also be used to create the desired hot air or steam.

Figure 6:
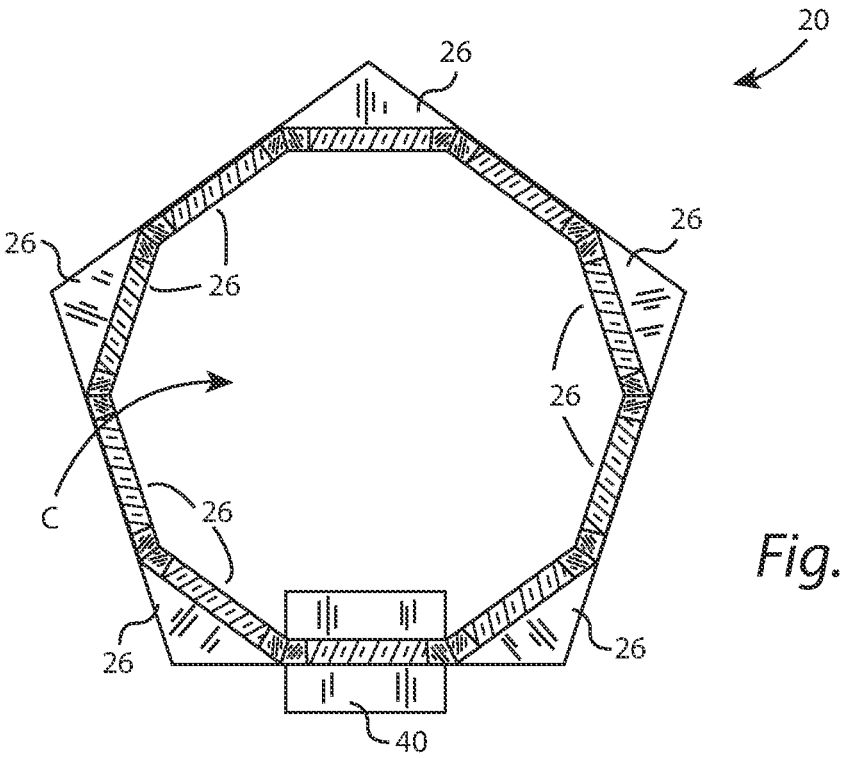
FIG. 6 is a cross-sectional view taken along line 6-6 of FIG. 5.

FIG. 6 is a cross-sectional view taken along line 6-6 of FIG. 5. The cross-section through a mid-point of the ten sidewall triangular structural panels 26 is a regular 10-sided polygon (a/k/a decagon). Five of the sidewall triangular structural panels 26 form base in the form of a regular 5-sided polygon (a/k/a pentagon). The heater unit 40 is shown extending through a triangular structural panel 26 to provide at least one of heated air and steam within the chamber C of sauna 20.

Figure 7:
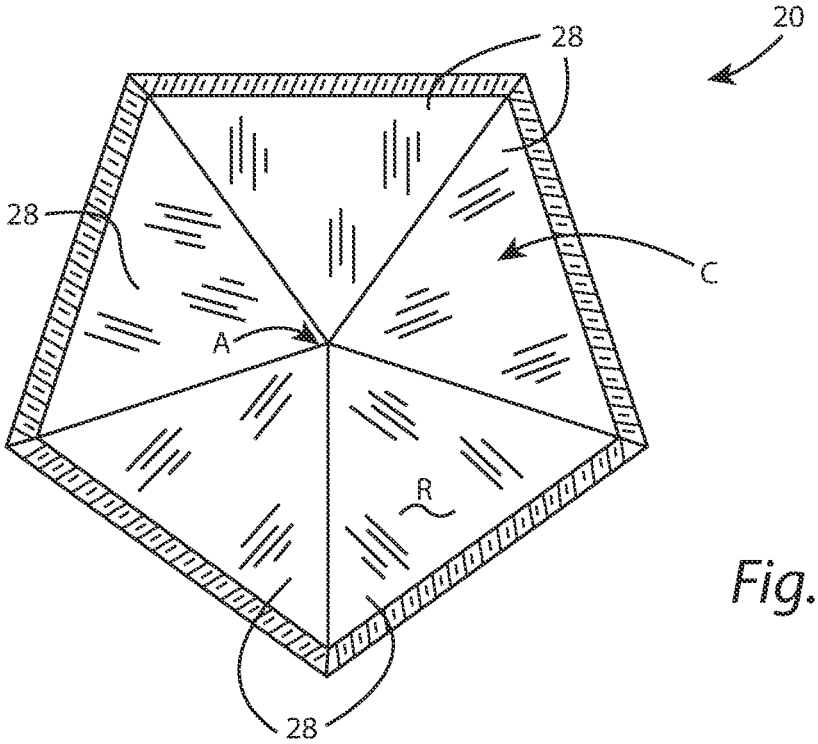
FIG. 7 is a cross-sectional view taken along line 7-7 of FIG. 5.

FIG. 7 is a cross-section view taken along line 7-7 of FIG. 5 looking up into an interior portion of roof R, which forms a part of the chamber C. The cross section through the roof R shows a base portion of the rooftop structural panels 28 forming a regular, 5-sided polygon (a/k/a pentagon) and extending up to the apex A.

Figure 8:
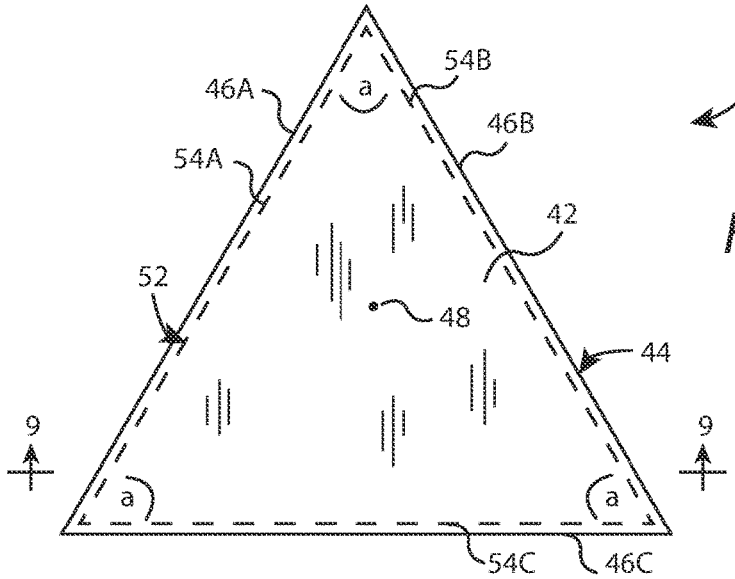
FIG. 8 is a front elevational view of a triangular structural panel.
Figure 9:
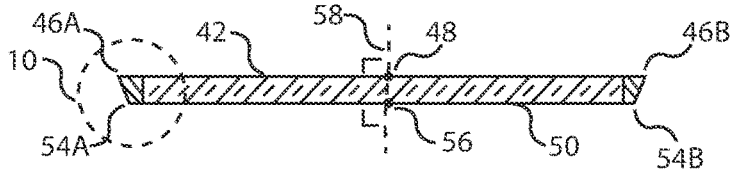
FIG. 9 is a cross-sectional view taken along line 9-9 of FIG. 8.

FIG. 8 is a front elevational view of an example triangular structural panel T (e.g. a structural panel 26, 28) and FIG. 9 is a cross-sectional view taken along line 9-9 of FIG. 8. The triangular structural panel T has a substantially planar outer surface 42 configured as a first equilateral triangle 44 having a first set of three congruent edges 46A, 46B and 46C and defining a first centroid (a/k/a center point) 48. The triangular structural panel 26/28 also has a substantially planar inner surface 50 configured as a second equilateral triangle 52 having a second set of three congruent edges 54A, 54B and 54C and defining a second centroid 56. The edges 46A, 46B and 46C of the first set of three congruent edges are longer than the edges of the edges 54A, 54B and 54C of the second set of three congruent edges, and each edge of the first set of three congruent edges is substantially parallel with a corresponding edge of the second set of three congruent edges of the second of the three congruent edges, e.g. edge 46A is parallel to edge 54A, edge 46B is parallel to edge 54B, and edge 46C is parallel to edge 54C. The first centroid 48 and the second centroid 56 are aligned such that an axis 58 going through both the first centroid and the second centroid is substantially perpendicular to the outer surface 42 and the inner surface 50. The internal angle "a" of the first equilateral triangle 44 and the second equilateral triangle is optimally 60 degrees. It will therefore be appreciated that the triangular panel structure has a beveled triangular configuration with a simple angle along its edges and a compound angle at its three vertices.

Figure 10:
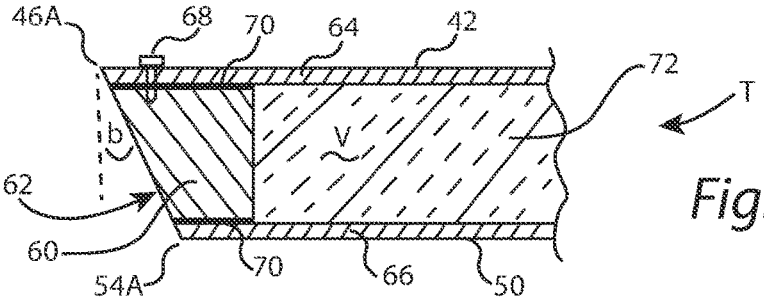
FIG. 10 is an enlarged view of the portion of FIG. 9 encircled by the broken line 10.

FIG. 10 is an enlarged view of the portion of FIG. 9 encircled by broken line 10 and illustrates an example construction for the triangular structural panel T. In this embodiment, a frame 60 forms the beveled triangular configuration having a simple angle "b" along the edges and a compound angle "a" and "b" at the three vertices. The frame 60 provides compression surfaces 62 along the edges of the panel T and can be made from a variety of materials, including wood, metal, fiberglass and plastic. The panel T includes an outer skin 64 providing outer surface 42 and an inner skin 66 providing inner surface 50, where the outer skin 64 and the inner skin 66 are mechanically or adhesively attached to the frame 60, e.g. with screws 68 and/or glue 70. The outer skin 64 and the inner skin 66 can be made from a variety of materials including wood, metal, fiberglass and plastic, but are preferably made from a weather and steam resistant material, such as aluminum sheets. An internal void V is at least partially filled with a thermal insulator 72 such as a foam board or an expanding liquid foam. Alternatively, the void V can provide thermal insulation with an air gap. In an embodiment, there is no void V such that the triangular structural panel T is solid. In another embodiment, the triangular structural panel T is unitary in structure and is made from a solid material such as wood, metal, fiberglass or plastic.

The bevel angle "b" is chosen to provide good contact between adjacent panels T when assembled into the multiuser sauna 20. In this example embodiment, the angle "b" of the sidewalls is preferably between 19 degrees and 23 degrees, more preferably between 20 degrees and 22 degrees, and most preferably between 20.5 degrees and 21.5 degrees. For certain embodiments, an angle of about 20.9 degrees has been found to be optimal. The chosen angle "b" can be dependent upon the compliance of the sidewalls of the panels T and the desired level of sealing between the panels T when assembled.

Figure 10A:
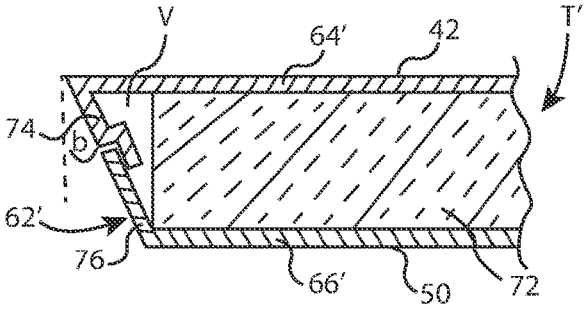
FIG. 10A is an enlarged view of a first alternate embodiment of the portion of the triangular structural panel of FIG. 9 encircled by the broken line 10.

FIG. 10A illustrates a first alternative example construction for a triangular structural panel T', with like references referring to like elements. In this embodiment, the frame 60 of FIG. 10 is eliminated and a folded edge portion 74 of outer skin 64' is configured to receive a folded end portion 76 of inner skin 66'. The folded edge portions 74 and 76 can be attached together mechanically or adhesively and together form compression surfaces 62' at an appropriate bevel angle "b" as explained above. The void V, in this example, is at least partially filled with thermal insulation, such as a foam board 72.

Figure 10B:
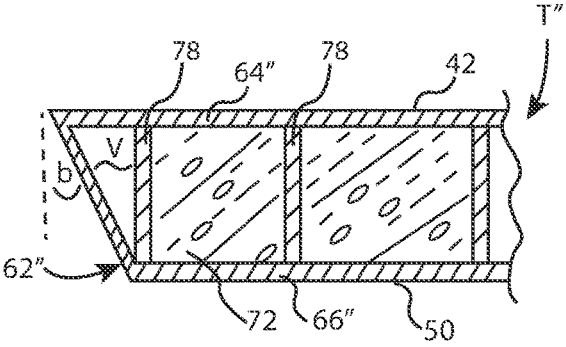
FIG. 10B is an enlarged view of a second alternate embodiment of the portion of the triangular structural panel of FIG. 9 encircled by the broken line 10.

FIG. 10B illustrates a second alternative example construction for a triangular structural panel T", with like elements referring to like elements. In this example, the structural panel T" is made from a molded plastic material, such as an injection molded or blow molded plastic, and can be made in a unitary fashion or assembled from a number of component pieces. As in the previous embodiments, compression sidewalls 62" are formed at an angle "b" from the plastic material. One or more ribs 78 can be provided between an outer skin 64" and an inner skin 66" to make the panel T" more rigid, and a foam material 72" (e.g. spray foam) can be provided within the void V to provide additional thermal insulation.

Figure 11:
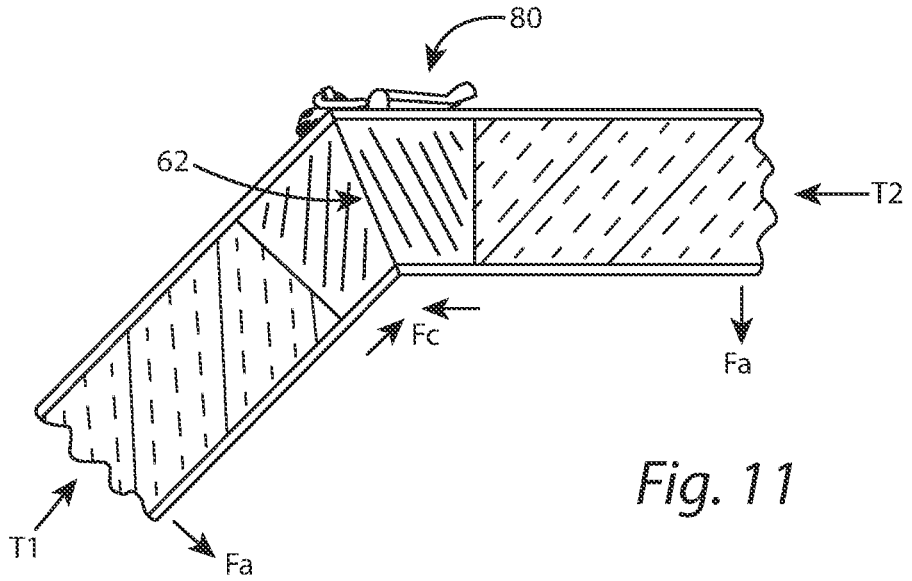
FIG. 11 is a cross-sectional view showing portions of two triangular structural panels held in compression by a toggle clamp.

FIG. 11 is a cross-sectional view of a first triangular structural panel T1 and a second triangular structural panel T2 of FIG. 10 coupled together with a compression connector 80 which exerts a compressive force Fc on the compression surfaces 62 of panels T1 and T2. There are also axial forces Fa on each of the panels T1 and T2 due to the compressive attachments of the remaining panels in a closed loop. Compression connector 80 is available, for example, on the Amazon website as a "toggle latch clamp hasp" or simply an "adjustable toggle clamp." Other suitable compression connectors include "rubber flexible hasp T-handle draw latches," which are also available on the Amazon website.

Figure 12:
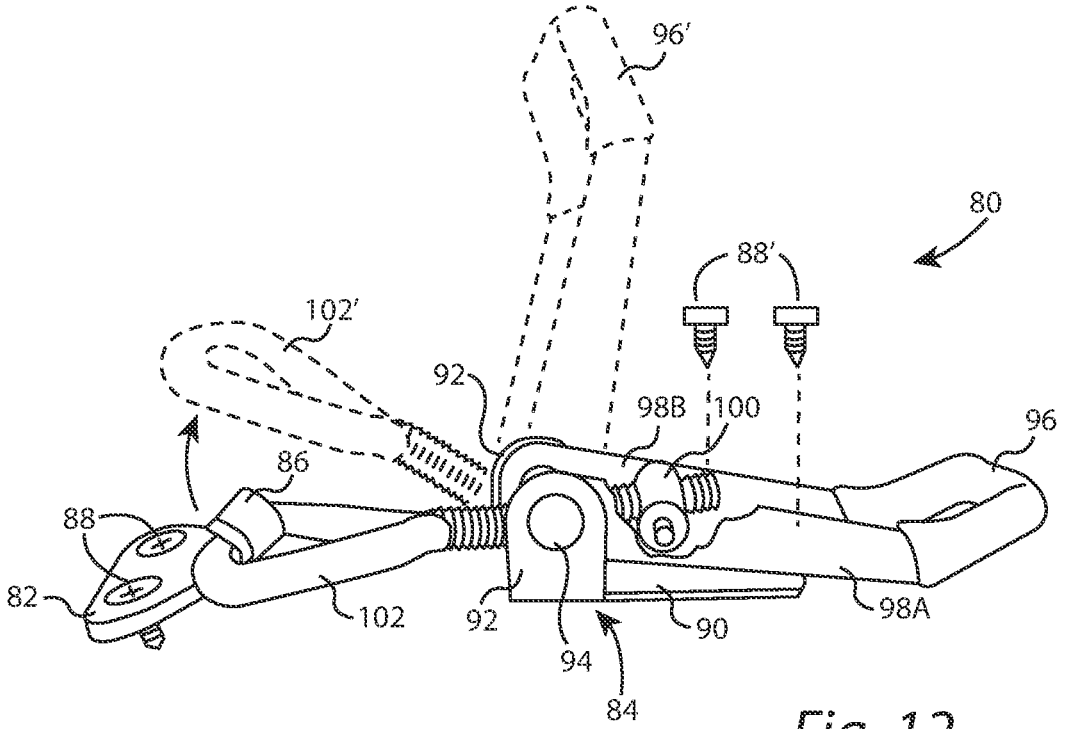
FIG. 12 is a perspective view of a toggle clamp of FIG. 11.

FIG. 12 is a perspective view of the example compression connector 80 of FIG. 11 illustrating an anchor 82 and a toggle clamp 84. The anchor 82 has a curved tang 86 and is attached to panel T1, e.g. with screws 88. The toggle clamp 84 includes a base 90 having a pair of posts 92 supporting a pivot pin 94 of a U-shaped lever 96 having arms 98A and 98B. Base 90 can be attached to panel T2 with screws 88'. A portion of arm 98A has been broken away to reveal a cylindrical nut 100 having axial pins engaged with holes provided in arms 98A and 98B to allow rotation. The nut 100 also has a threaded, diametric bore that is engageable with a threaded shaft of an eyebolt 102, which allows for adjustment of the length of the eyebolt 102 extending from the cylindrical nut 100. The lever 96 is shown in its over-center or clamping position which exerts a compressive force between the anchor 82 attached to panel T1 the toggle clamp 84 attached to panel T2. When the lever 96 is lifted to a position 96' the eyebolt disengages with the tang 86 as indicated at 102' and the compressive pressure is released.

Figure 13A:
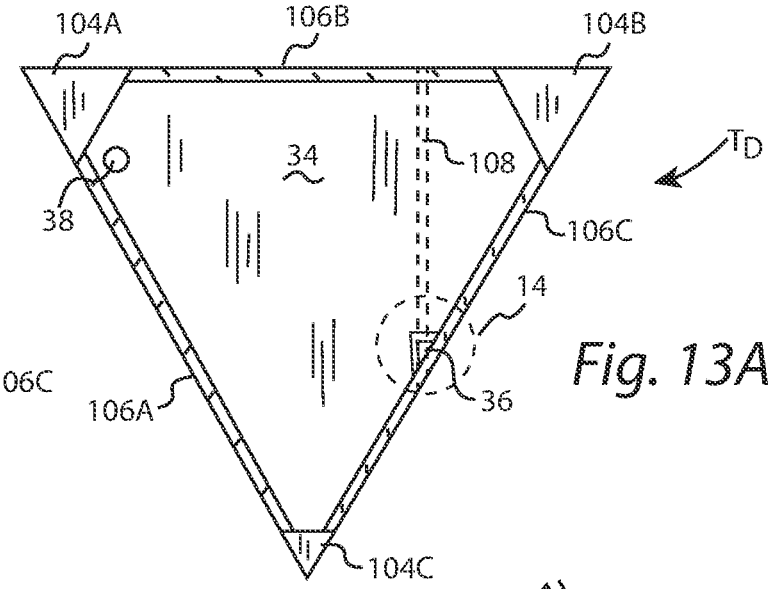
FIG. 13A is an elevational view of a triangular structural panel provided with a door.
Figure 14:
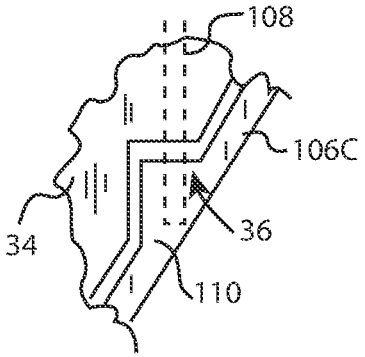
FIG. 14 is an enlarged view of a portion of the triangular structural panel of FIG. 13A encircled by broken line 14.
Figure 13B:
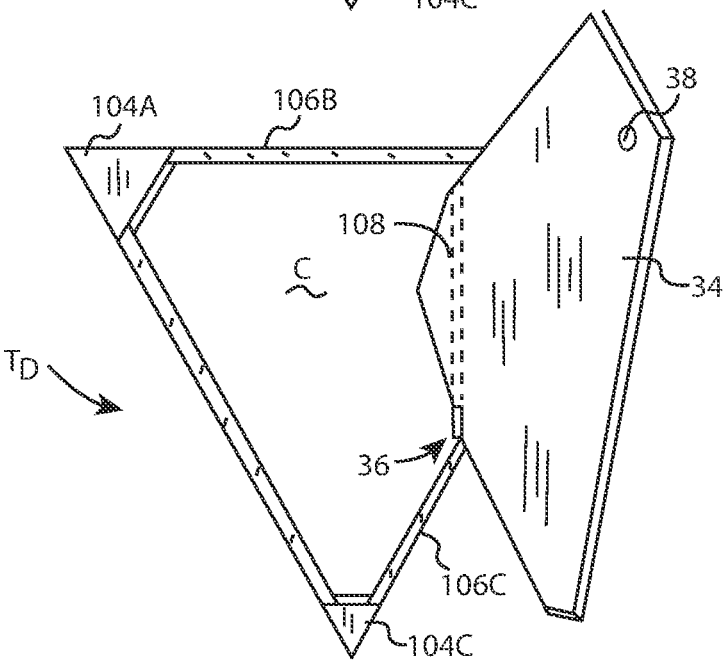
FIG. 13B is an elevational view of the triangular structural panel of FIG. 13A with the door open.

FIG. 13A is a front elevational view of an example triangular structural panel $T_D$ provided with a door 34 supported by a hinge 36 and having a knob 38. The basic construction of the panel TD is other than the door 36 similar to that of example triangular structural panel T of FIGS. 8-10, e.g. door frame vertices 104A, 104B and 104C of panel $T_D$ have a compound angle and the three congruent edges 106A, 106B and 106C are beveled to provide compression surfaces. The door 34 is triangular and has all three vertices truncated to accommodate the door frame vertices 104A, 104B and 104C. The hinge 36 includes a hinge pin 108 that extends through the door 34 between edges 106B and 106C of the door frame. As seen also seen in FIG. 14, edge 106C can be provided with a reinforcement portion 110 to help support the weight of the door 36. The door is shown to be rotated around the hinge pin 108 to an open position in FIG. 13B to allow access to the chamber C of the sauna.

Example

To make a triangular structural panel as illustrated in FIGS. 8-10, a triangular frame of a western red cedar that is 1.5 inches thick is clad with two 0.040-inch aluminum sheets (e.g. 5250 aluminum sheets) screwed onto the frame both inside and out. Foam board insulation, such as 1½ inch R-Tech EPS Rigid Foam Board Insulation, is provided within the frame between the two aluminum sheets. The frame includes three western red cedar 2"×4" sticks ripped at a 20.5° angle. Each angled stick is then cut to 62.25 inches with a compound angle (20.5° by 60°) on one end and a 60° angle cut on the other. Three of the sticks are attached at opposite ends to create a 64-inch triangle with a 20.5° edge on each side. Bench seats in the shape of a decagon can be provided in the interior to accommodate multiple persons (e.g., up to six) when using fifteen triangular structure panels of this size. Increasing the length of the sticks, even by a few inches, significantly increases the occupancy capacity of the sauna.

Although various embodiments have been described using specific terms and devices, such description is for illustrative purposes only. The words used are words of description rather than of limitation. It is to be understood that changes and variations may be made by those of ordinary skill in the art without departing from the spirit or the scope of various inventions supported by the written disclosure and the drawings. In addition, it should be understood that aspects of various other embodiments may be interchanged either in whole or in part. It is therefore intended that the claims be interpreted in accordance with the true spirit and scope of the invention without limitation or estoppel.

What is claimed is:

1. A portable multiuser sauna comprising:

an enclosure configured as a truncated, regular icosahedron with ten sidewall triangular structural panels and five rooftop triangular structural panels, wherein each sidewall triangular structural panel is compressively coupled to at least two adjacent triangular structural panels, wherein each of the triangular structural panels include, a substantially planar outer surface configured as a first equilateral triangle having a first set of three congruent edges and defining a first centroid;

a plurality of compression connectors coupled to the outer surface proximate to a plurality of edges of the first set of three congruent edges;

a substantially planar inner surface configured as a second equilateral triangle having a second set of three congruent edges and defining a second centroid, wherein edges of the first set of three congruent edges are longer than the edges of the second set of three congruent edges, wherein each edge of the first set of three congruent edges is substantially parallel with a corresponding edge of the second set of three congruent edges, and wherein an axis through the first centroid and the second centroid is substantially perpendicular to the outer surface and the inner surface; and three compression sidewalls extending between corresponding edges of the first set of three congruent edges and the second set of three congruent edges; and a heater unit providing at least one of heated air and steam within the enclosure;

whereby the enclosure is supported by the compressive coupling of the triangular structural panels without the need for a support structure.

2. A portable multiuser sauna as recited in claim 1 wherein the heater unit is one of a dry sauna heater and a steam generator.

3. A portable multiuser sauna as recited in claim 2 wherein at least one of the ten sidewall triangular structural panels comprises a door.

4. A portable multiuser sauna as recited in claim 3 further comprising a perimeter foundation for the sidewall triangular structural panels.

5. A portable multiuser sauna as recited in claim 4 wherein the perimeter foundation comprises five wooden members, wherein each wooden member is compressively coupled to two adjacent wooden members.

6. A method for assembling a portable multiuser sauna comprising:

coupling ten sidewall triangular structural panels together in a closed loop by compressively latching vertically extending edges of alternately oriented sidewall triangular structural panels;

coupling five rooftop triangular structural panels together as a five sided pyramid on top of the ten sidewall triangular structural panels by compressively latching the rooftop triangular structural panels to each other and to five of the sidewall triangular structural panels, whereby the sidewall triangular structural panels and the roof building panels comprise an enclosure supported by the compressive coupling of the triangular structural panels without the need for a support structure; and installing a heater unit to provide at least one of heated air and steam within the enclosure.

7. A method for assembling a portable multiuser sauna as recited in claim 6 further comprising coupling five wooden members into a pentagonal perimeter foundation for the enclosure.

8. A method for assembling a portable multiuser sauna as recited in claim 6 wherein at least one of the sidewall triangular structural panels comprises a door.

9. A compression mounted triangular structural panel comprising:

a substantially planar outer surface configured as a first equilateral triangle having a first set of three congruent edges and defining a first centroid;

a plurality of compression connectors coupled to the outer surface proximate to a plurality of edges of the first set of three congruent edges;

a substantially planar inner surface configured as a second equilateral triangle having a second set of three congruent edges and defining a second centroid, wherein edges of the first set of three congruent edges are longer than the edges of the second set of three congruent edges, wherein each edge of the first set of three congruent edges is substantially parallel with a corresponding edge of the second set of three congruent edges, and wherein an axis through the first centroid and the second centroid is substantially perpendicular to the outer surface and the inner surface; and three compression sidewalls extending between corresponding edges of the first set of three congruent edges and the second set of three congruent edges.

10. A compression mounted triangular structural panel as recited in claim 9 wherein the first set of three congruent edges intersect in a first set of vertices with 60 degree internal angles.

11. A compression mounted triangular structural panel as recited in claim 10 wherein the second set of three congruent edges intersect in a second set of vertices with 60 degree internal angles.

12. A compression mounted triangular structural panel as recited in claim 11 wherein a sidewall angle of each of the three compression sidewalls from the outer surface to the inner surface is between 19 degrees and 23 degrees, whereby adjacent sidewalls intersect at vertices with compound angles.

13. A compression mounted triangular structural panel as recited in claim 12 wherein the sidewall angle is between 20 degrees and 22 degrees.

14. A compression mounted triangular structural panel as recited in claim 13 wherein the sidewall angle is between 20.5 and 21.5 degrees.

15. A compression mounted triangular structural panel as recited in claim 14 wherein the sidewall angle is about 20.9 degrees.

16. A compression mounted triangular structural panel as recited in claim 9 wherein the outer surface is spaced from the inner surface to define an internal void.

17. A compression mounted triangular structural panel as recited in claim 16 wherein the three compression walls comprise a frame having an outer face and an inner face, wherein the outer surface comprises an outer panel attached to the outer face of the frame, and wherein the inner surface comprises an inner panel attached to the inner face of the frame.

18. A compression mounted triangular structural panel as recited in claim 17 wherein the frame comprises one or more of wood, metal, fiberglass and plastic.

19. A compression mounted triangular structural panel as recited in claim 18 wherein the outer panel and the inner panel comprise one or more of wood, metal, fiberglass and plastic.

20. A compression mounted triangular structural panel as recited in claim 16 wherein the internal void is at least partially filled with a thermal insulator.

21. A compression mounted triangular structural panel as recited in claim 16 wherein the internal void is provided with at least one brace between the outer surface and the inner surface.

22. A compression mounted triangular structural panel as recited in claim 9 wherein the outer surface, the inner surface, and the three compression sidewalls comprise a molded plastic material.

23. A compression mounted triangular structural panel as recited in claim 11 wherein one or more of the vertices are truncated.

24. A compression mounted triangular structural panel as recited in claim 11 wherein one or more of vertices is provided with a window.

25. A compression mounted triangular structural panel as recited in claim 9 wherein a door opening is provided between the outer surface and the inner surface, and further comprising a door hinged within the door opening.

26. A compression mounted triangular structural panel as recited in claim 9 wherein an opening is provided between the outer surface and the inner surface to accommodate a heater.

27. A compression mounted triangular structural panel as recited in claim 9 wherein the panel is a unitary, solid material comprising one of wood, metal, fiberglass and plastic.

* * * * *